US005255803A

United States Patent [19]

Pavone et al.

[11] Patent Number: 5,255,803

[45] Date of Patent: Oct. 26, 1993

[54] MERCHANDISING SYSTEM

[75] Inventors: Jerry D. Pavone; Paul D. Aubke; Kevin P. Shatzer, all of Cincinnati, Ohio

[73] Assignee: Hamilton Fixture Company, Cincinnati, Ohio

[21] Appl. No.: 679,914

[22] Filed: Apr. 3, 1991

[51] Int. Cl.[5] ..... A47B 47/00

[52] U.S. Cl. ..... 211/189; 211/94; 211/90; 40/606; 248/121; 248/220.2; 248/243

[58] Field of Search ..... 211/189, 94, 87, 206; 40/606, 607, 610; 52/145; 160/351; 248/345.1, 243, 346, 121, 220.2

[56] References Cited

U.S. PATENT DOCUMENTS

| | | | |
|---|---|---|---|
| 614,432 | 11/1898 | Austin | 40/606 X |
| 646,053 | 3/1900 | Humphrey | 40/606 X |
| 751,832 | 2/1904 | Cahn et al. | 40/606 |
| 2,345,913 | 4/1944 | Bishop | 160/351 X |
| 3,326,505 | 6/1967 | Jamar, Jr. | 211/189 X |
| 3,655,159 | 4/1972 | Held, Jr. | 211/187 X |
| 3,895,720 | 7/1975 | Presberg | 211/126 X |
| 3,994,466 | 11/1976 | Troup | 248/345.1 |
| 4,115,937 | 9/1978 | Wolpert | 40/606 X |
| 4,127,196 | 11/1978 | Boucher | 160/351 X |
| 4,135,837 | 1/1979 | Suttles | 211/189 X |
| 4,148,263 | 4/1979 | Suttles | 211/153 X |
| 4,591,058 | 5/1986 | Amstutz et al. | 211/87 X |
| 4,805,783 | 2/1989 | Mayer | 211/189 X |
| 5,012,603 | 5/1991 | Elcock | 40/607 X |

FOREIGN PATENT DOCUMENTS

| | | | |
|---|---|---|---|
| 2000641 | 4/1990 | Canada | 211/189 |
| 2816919 | 11/1978 | Fed. Rep. of Germany | 211/189 |
| 3718440 | 12/1988 | Fed. Rep. of Germany | 40/606 |
| 90/11590 | 10/1990 | PCT Int'l Appl. | 40/606 |
| 90/11591 | 10/1990 | PCT Int'l Appl. | 40/606 |
| 2070915 | 9/1981 | United Kingdom | 211/189 |

*Primary Examiner*—Alvin C. Chin-Shue
*Assistant Examiner*—Korie H. Chan
*Attorney, Agent, or Firm*—Frost & Jacobs

[57] ABSTRACT

A merchandising system for display of items for sale. The merchandising system constitutes display units each comprising a rectangular base assembly and an upright frame assembly mounted thereon along the long axis thereof. The base assembly comprises a pair of end members joined together by a pair of parallel spaced outer tubular members defining the base sides and by an interior tubular member intermediate the outer tubular members. The base assembly is provided with casters and a replaceable cover providing the base with a smooth upper surface. The frame assembly comprises at least a pair of upright frame members removably affixed to the base intermediate tubular member and joined at their upper ends by a horizontal frame member. The frame assembly is capable of supporting standard hardware and accessories such as bracket-supported shelving, horizontal hangbars, faceouts, waterfalls, and the like. The frame assembly is also capable of surrounding and supporting single panels or back-to-back panels such as solid panels, slotted panels, wire grid panels and slotwall panels. The slotted, wire grid and slotwall panels are capable of supporting standard hardware and accessories useable therewith. The frame assembly may be divided by an intermediate upright frame member. The horizontal frame member can be replaced by a table top and the upright frame members can support shelves to convert a display unit to a feature table.

28 Claims, 11 Drawing Sheets

MERCHANDISING SYSTEM

TECHNICAL FIELD

The invention relates to a flexible merchandising system comprising display units, each of which can be expanded, moved and converted in minutes to create a new look and function.

BACKGROUND ART

It has long been realized that the retail environment and the manner in which items for sale are displayed constitute major factors in successful retail selling. As a consequence of this, prior art workers have devised numerous types of display units which are both aesthetically pleasing and convenient for the consumer. The display units are intended to advantageously display merchandise supported thereon with convenient access thereto for the consumer. As a result of this, numerous types of standardized hardware and accessories have been developed for such display units including various types of panels, shelf brackets and shelving, faceout brackets, waterfall brackets, divided shelves, bins, trays and other specialized merchandise display means.

In recent times, efforts have been directed to coordinating the retail shop or department and its display units with respect to appearance, color, arrangement and the like to provide an attractive retail environment. At the same time, it has been found important to periodically update the retail environment to keep up with new styles, trends and the like. Unfortunately, such updating is generally expensive, requiring both remodeling of the store or department and replacement of the display units.

The present invention is directed to a merchandising system, the display units of which can change with the surroundings. The display units of the system of the present invention are compatible with standard hardware and accessories. The basic fixtures of the system of the present invention can be expanded, moved and converted in minutes to create a new look and function. As a result, it is no longer necessary to dispose of the display units and replace them with new display units at great expense.

DISCLOSURE OF THE INVENTION

According to the invention there is provided a merchandising system for the display of items for sale. The merchandising system constitutes one or more display units each comprising a rectangular base assembly having sides and ends and an upright frame assembly removably mounted thereon along the centerline thereof extending from end-to-end. The base assembly comprises a pair of planar vertically oriented end members joined together by a pair of parallel, spaced, outer tubular members of circular cross-section defining the base sides and by an inner tubular member of rectangular cross-section intermediate the outer tubular members. The base assembly is provided with casters and a replaceable cover providing the base with a smooth upper surface. The frame assembly comprises at least a pair of upright frame members removably affixed to the base and joined at their upper ends by a removable horizontal frame member. The frame assembly is capable of supporting standard hardware and accessories such as bracket-supported shelving, horizontally oriented hangbars, faceouts, waterfalls, and the like. The frame assembly is also capable of surrounding and supporting a single panel or a pair of back-to-back panels such as solid panels, slotted panels, wire grid panels and slotwall panels. The slotted, wire grid and slotwall panels are capable of supporting standard hardware and accessories useable therewith. The frame assembly may be provided with an intermediate upright frame member removably mounted to the base member and the horizontal frame member. The horizontal frame member is replaceable by a table top and the upright frame members can support horizontally oriented shelves to convert a unit to a feature table.

DETAILED DESCRIPTION OF THE INVENTION

Figure 1:
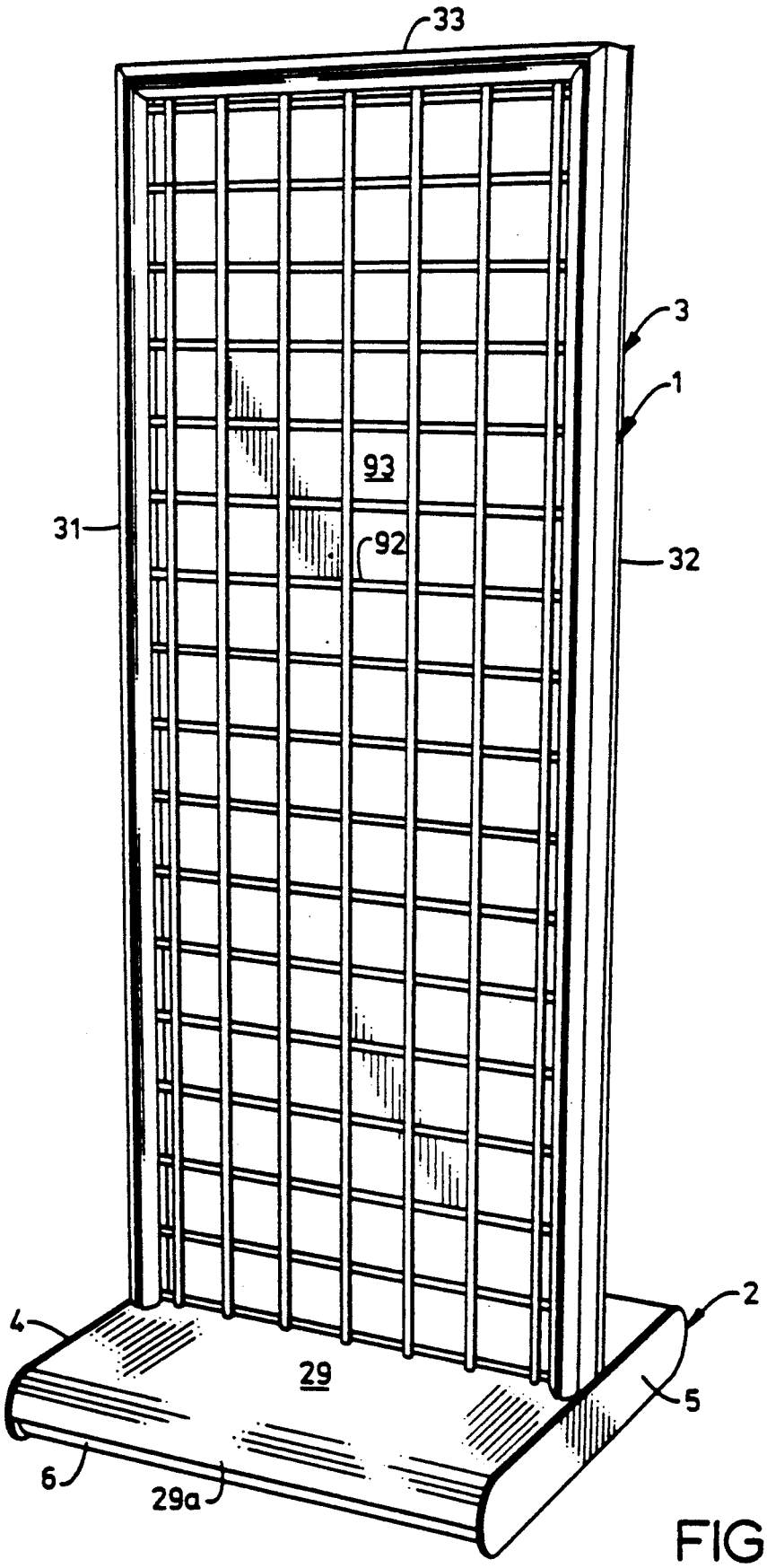
FIG. 1 is a perspective view of an exemplary display unit of the merchandising system of the present invention.

Referring first to FIG. 1, this Figure illustrates an exemplary embodiment of display unit of the merchandising system of the present invention. The embodiment is generally indicated at 1 and comprises a base assembly generally indicated at 2 and an upright frame assembly generally indicated at 3.

Figure 2:
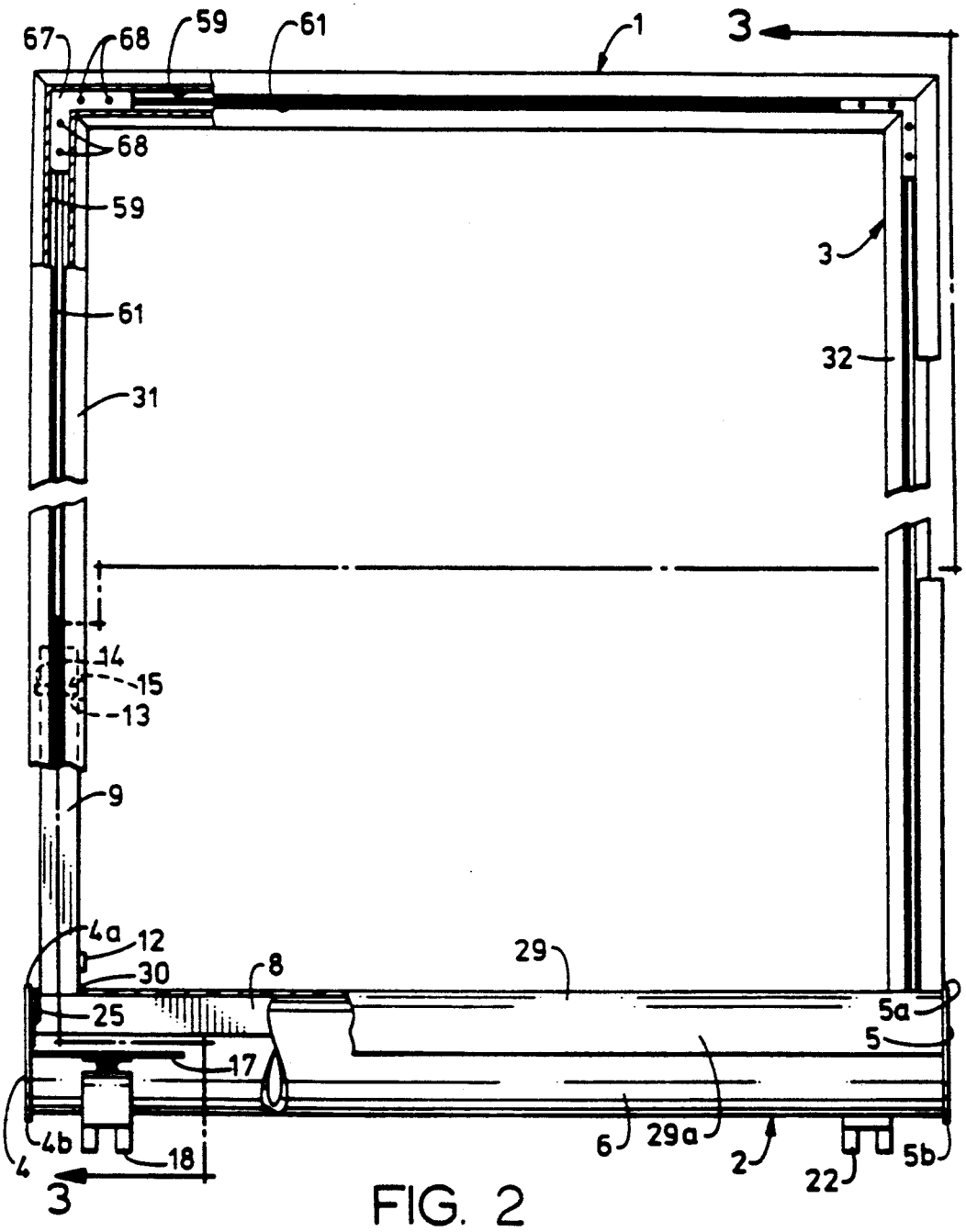
FIG. 2 is a fragmentary elevational view, partly in cross-section, of the base assembly and frame assembly of the display unit of FIG. 1.
Figure 3:
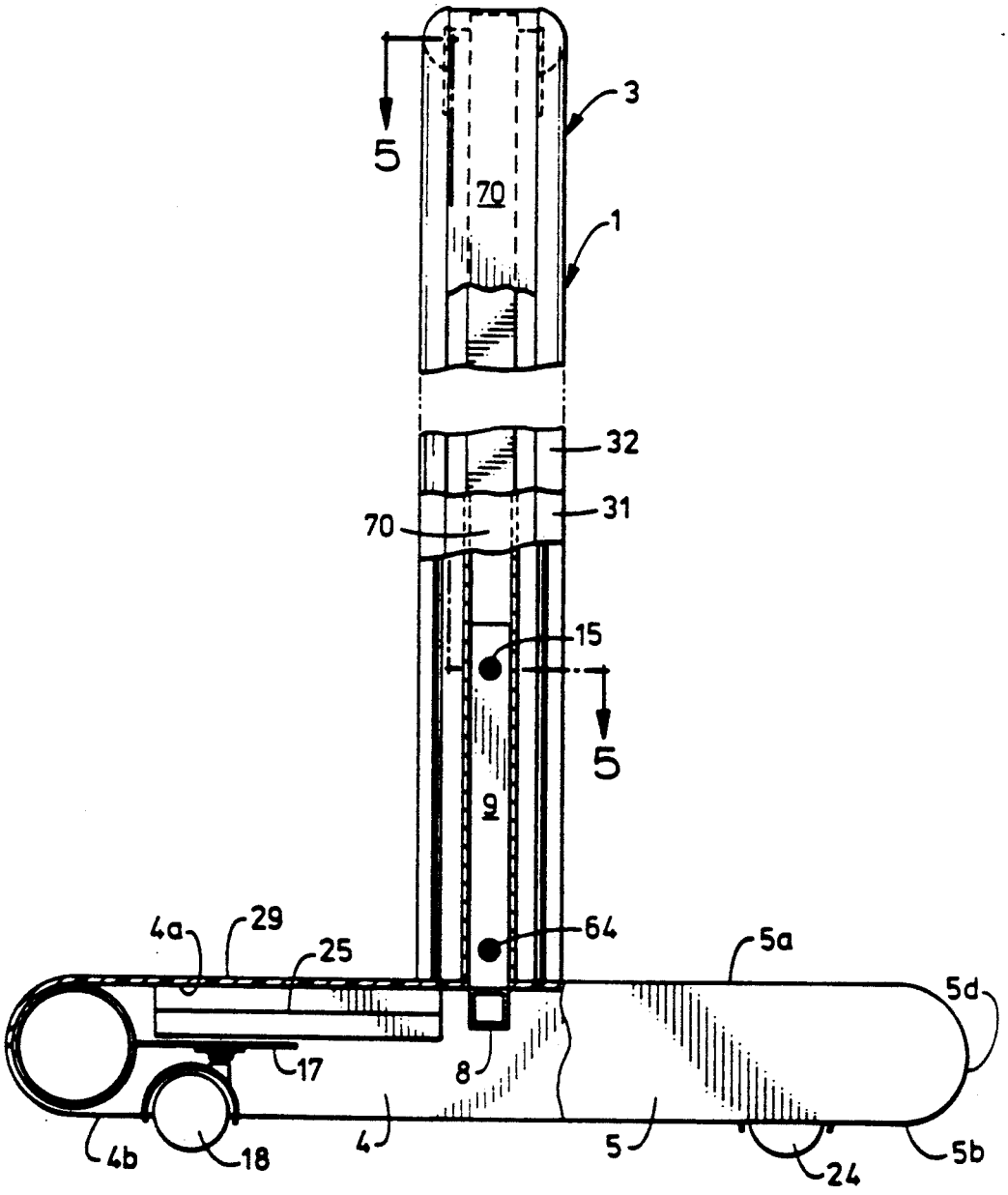
FIG. 3 is a fragmentary end view, partly in cross-section, of the structure of FIG. 2.
Figure 4:
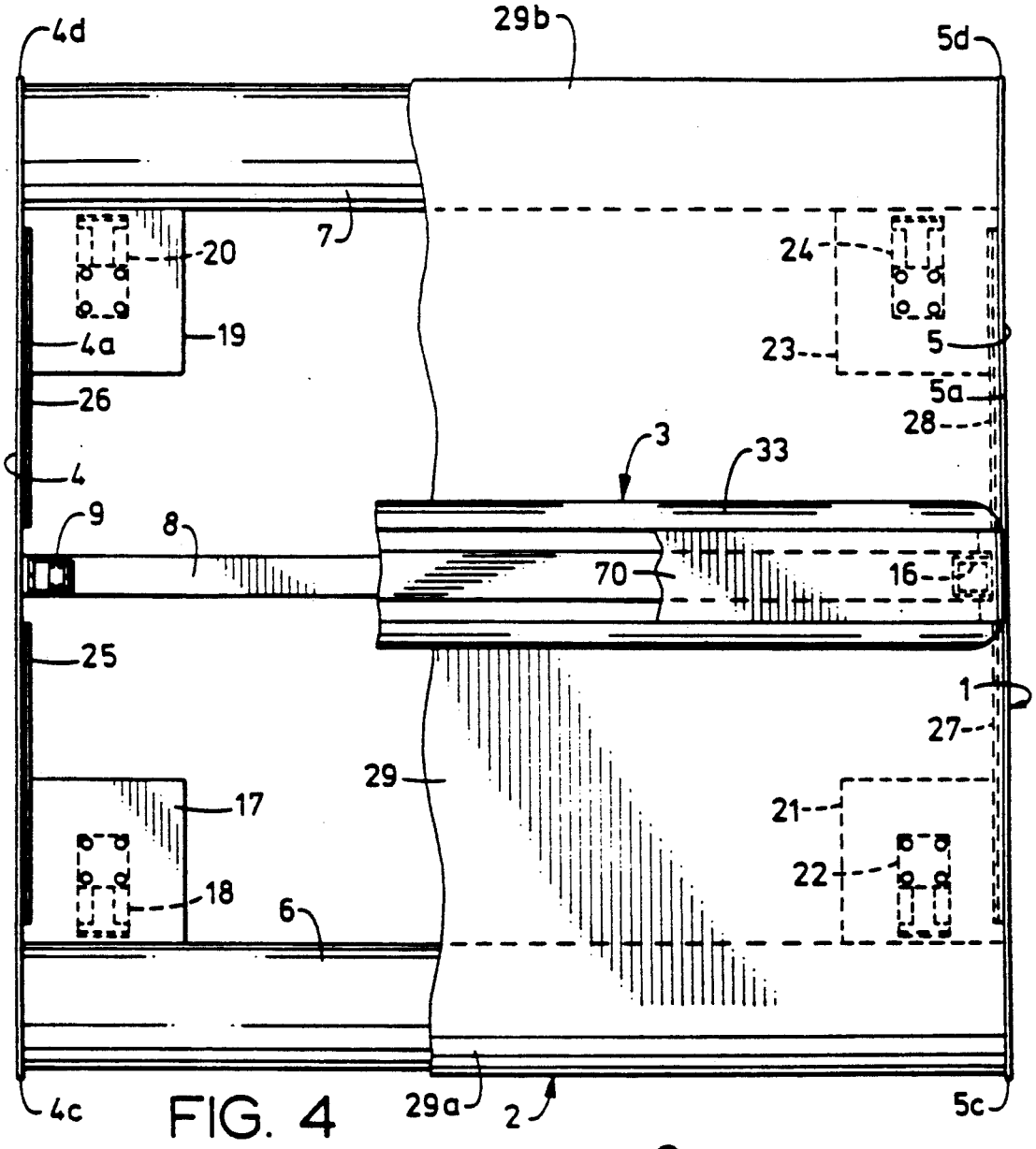
FIG. 4 is a fragmentary plan view of the structure of FIGS. 2 and 3.

The base assembly of the present invention is best shown in FIGS. 2, 3 and 4. The base comprises a pair of planar, plate-like, vertically oriented end members 4 and 5. End member 4 has horizontal upper and lower edges 4*a* and 4*b* together with rounded ends 4*c* and 4*d*. End member 5 is substantially identical to end member 4, having horizontal upper and lower edges 5*a* and 5*b* and rounded ends 5*c* and 5*d*.

End members 4 and 5 are joined together by a pair of outer tubular members 6 and 7, of circular cross-section. The ends of tubular member 6 are fixed adjacent the ends 4*c* and 5*c* of end members 4 and 5 by fillet welds or the like. Similarly, the outer tubular member 7 is affixed to the end members 4 and 5 adjacent their rounded ends 4*d* and 5*d* by fillet welds. It will be apparent from FIGS. 3 and 4 that the outer tubular members 6 and 7 are just slightly inset from the rounded ends 4*c* and 4*d* of end member 4 and the rounded ends 5*c* and 5*d* of end member 5. End members 4 and 5 are additionally joined together by an intermediate tubular member 8 welded thereto at the center thereof just below their upper horizontal edges 4*a* and 5*a*. The intermediate tubular member 8 is of rectangular cross-section.

Adjacent the juncture of intermediate tubular member 8 and end member 4, the upper surface of tubular member 8 supports a vertically extending tubular lug 9. The lug 9 may be made of the same rectangular tubular material as the intermediate tubular member 8 and is welded or otherwise appropriately affixed thereto. The purpose of lug 9 will be apparent hereinafter.

Figure 5:
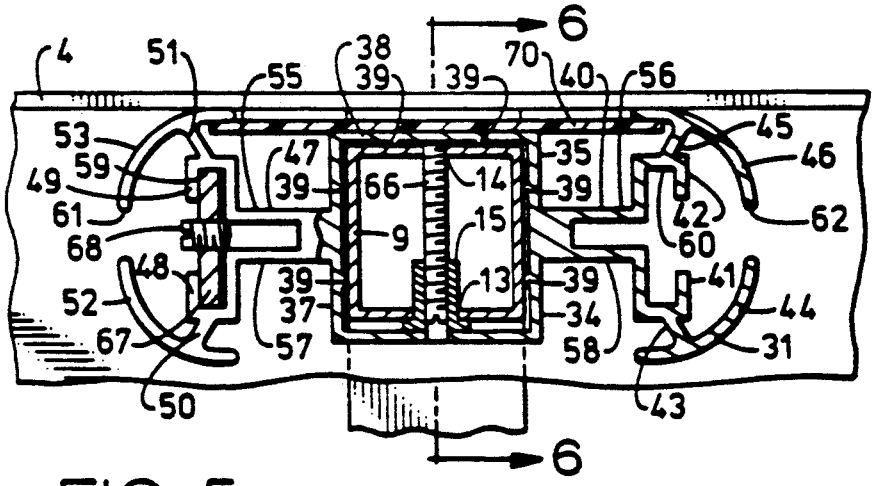
FIG. 5 is a fragmentary cross-sectional view taken along section line 5—5 of FIG. 3.
Figure 6:
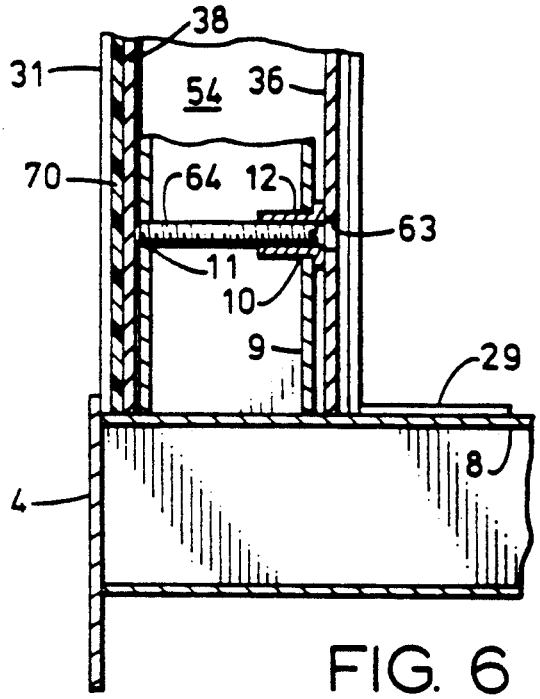
FIG. 6 is a fragmentary cross-sectional view taken along section line 6—6 of FIG. 5.

As is most clearly shown in FIG. 6, the lug 9, near its bottom end, is provided with a pair of coaxial perforations 10 and 11. The perforation 10 receives a threaded bushing 12, the purpose of which will be explained hereinafter. As is shown in FIGS. 2, 3 and 5, the lug 9, near its upper end, has a second pair of coaxial perforations 13 and 14. The perforation 13 receives a threaded bushing 15, similar to threaded bushing 12. The intermediate tubular member 8, near its junction with end member 5, supports a second upstanding lug 16 (see FIG. 4) substantially identical to upstanding lug 9 and provided with a pair of coaxial holes and a threaded bushing near its bottom end and near its top end (not shown) in the same manner described with respect to lug 9.

Referring to FIGS. 2, 3 and 4, a horizontal plate 17 is mounted on outer tubular member 6 and end member 4 at the juncture thereof by fillet welding or the like. A bracket-mount caster 18 is affixed to the plate 17 by bolts or other appropriate fastening means. In similar fashion, a horizontal plate 19 is affixed to outer tubular member 7 and end member 4 at the juncture thereof and supports a bracket-mounted caster 20. A horizontal plate 21 is affixed to outer tubular member 6 and end member 5 at the juncture thereof and supports a bracket-mounted caster 22. Finally, a horizontal plate 23 is affixed to outer tubular member 7 and end member 5 at the juncture thereof and supports a bracket-mounted caster 24.

A pair of Z-shaped brackets 25 and 26 are spot welded to end member 4 on either side of tubular member 8. The upper edges of Z-shaped brackets 25 and 26 are spaced inwardly from the inner surface of end member 4. The upper edges of brackets 25 and 26 are also spaced slightly downwardly of the upper edge 4*a* of end member 4, as can most easily be seen in FIG. 2. The end member 5 has a similar pair of Z-shaped brackets 27 and 28 spot welded to its inner surface on either side of tubular member 8. The upper edges of Z-shaped brackets 27 and 28 bear the same relationship to the upper edge 5*a* of end member 5 as do the upper edges of brackets 25 and 26 with respect to the upper edge 4*a* of end member 4.

The base assembly of the merchandising system of the present invention is completed by provision of a skirt 29. The skirt 29 comprises a planar sheet of appropriate material such as plastic or the like. As is evident from the drawings, the skirt 29 has arcuate edge portions 29*a* and 29*b* which overlie outer tubular members 6 and 7, respectively, and curve partway therearound. The edges of the skirt adjacent end members 4 and 5 abut the end members 4 and 5 and are supported by the upper edges of Z-shaped brackets 25, 26, 27 and 28. As is apparent from FIG. 2, the skirt 29 is notched as at 30 to accommodate upstanding lug 9. It will be understood that the opposite edge of skirt 29 will be similarly notched to accommodate upstanding lug 16.

In its simplest form, the upright frame assembly 3 comprises a pair of upright frame members 31 and 32 and a horizontal frame member 33 joining the upper ends of upright frame members 31 and 32. The upright frame members 31 and 32 and the horizontal frame member 33 may constitute extrusions of identical cross-section and of the type taught in U.S. Pat. No. Des. 317,051. Upright frame member 31 is illustrated in FIG. 5. A description of the cross-sectional configuration of upright frame member 31 will also serve as a description of the cross-sectional configurations of upright frame member 32 and horizontal frame member 33. Upright frame member 31 comprises an elongated member, the center of which constitutes a tubular portion 34 having sidewalls 35–38. The inside surface of each of the sidewalls 35–38 is provided with a pair of longitudinally extending, parallel, spaced ribs 39. The sidewall 35 has an exterior bifurcated web 40 extending outwardly thereof and centrally therealong. The bifurcations of web 40 terminate in opposed hook-shaped portions 41 and 42. The hook-shaped portion 41 has a web 43 extending therefrom and supporting an arcuate portion 44. Similarly, the hook-shaped portion 42 has a web 45 extending therefrom and supporting an arcuate portion 46. In similar fashion, the wall 37 of rectangular tubular portion 34 is provided with a bifurcated web 47 similar to web 40. The bifurcated web 47 terminates in a pair of hook-shaped portions 48 and 49 similar to hook-shaped portions 41 and 42. The hook-shaped portion 48 has an outwardly extending web 50 similar to web 43 and supporting an arcuate portion 52 similar to arcuate portion 44. The hook-shaped portion 49 has an outwardly extending web 51 similar to web 45 and supporting an arcuate portion 53 similar to portion 46. It will be evident from FIG. 5 that if upright frame member 31 were divided in half by an imaginary plane passing through the center lines of walls 36 and 38, the resulting halves would be symmetrical and mirror images of each other.

The cross-sectional configuration just described provides the upright 31 with a central, longitudinally extending, rectangular socket 54. This is flanked by a pair of longitudinally extending slots 55 and 56 facing to one side of upright 31. A similar pair of longitudinally extending slots 57 and 58 face the other side of upright 31. The opposed hook-shaped members 48 and 49 define a longitudinally extending slotted channel 59. Similarly, the opposed hook-shaped elements 41 and 42 define a longitudinally extending slotted channel 60. The arcuate members 52 and 53 are spaced from each other to define a longitudinally extending end slot 61. Similarly, the arcuate members 44 and 46 are spaced from each other, forming a longitudinally extending end slot 62.

The nature of the upright frame members 31 and 32 and the horizontal frame member 3 having been described, their assembly to the base 2 is accomplished in the following manner. Upright frame member 31 is mounted on base 2 with the upstanding base lug 9 located within the rectangular socket 54 of upright frame member 31. The sidewall 36 of the rectangular portion 34 of upright frame member 31 is provided with a perforation 63 (see FIG. 6) coaxial with the perforations 10 and 11 in the upstanding base lug 9. This enables a set screw 64 to be threadedly engaged in bushing 12. The set screw is tightened until its forward end passes through the perforation 11 of the base lug 9 and engages the inner surface of wall portion 38 of the rectangular part of upright frame member 31. The wall portion 36 of the rectangular part of upright frame member 31 is provided with a second perforation 65 (see FIG. 5) which is coaxial with the perforations 13 and 14 near the upper end of the base lug 9. This enables the engagement of a set screw 66 in bushing 15. The set screw 66 is tightened until its forward end passes through the perforation 14 in the base lug 9 and engages the inside surface of the wall 38 of the rectangular part of upright frame member 31. Thus, upright frame member 31 is mounted on base lug 9 and is removably affixed thereto by the set screws 64 and 66. It will be understood that the upright frame member 32 will be similarly mounted on the upstanding base lug 16.

The upper ends of upright frame members 31 and 32 are beveled at an angle of 45°, as is best shown in FIG. 2. The ends of the horizontal frame member 33 are correspondingly beveled. The horizontal frame member 33 is affixed to upright frame member 31 by a pair of angle elements, one of which is shown at 67 in FIGS. 2 and 5. One leg of angle element 67 is inserted in the slotted channel 59 of horizontal frame member 33. It will be understood that the second angle element of the pair will have one of its legs inserted in the slotted channel 60 of horizontal frame member 33. The free legs of the two channel members will then be inserted in the slotted channels 59 and 60 of upright frame member 31. The legs of angle element 67 are releasably affixed in their respective slotted channels 59 by set screws 68. Access to the set screws is gained through the longitudinal end slots 61 of the upright frame member 31 and the horizontal frame member 33. It will be understood that the other angle element (not shown) of the pair will be similarly affixed in the slotted channels 60 of upright frame member 31 and horizontal frame member 33 in the same manner. It will be further understood that the other end of horizontal frame member 33 will be similarly affixed to the upper end of upright frame member 32.

Figures 10A, 10B:
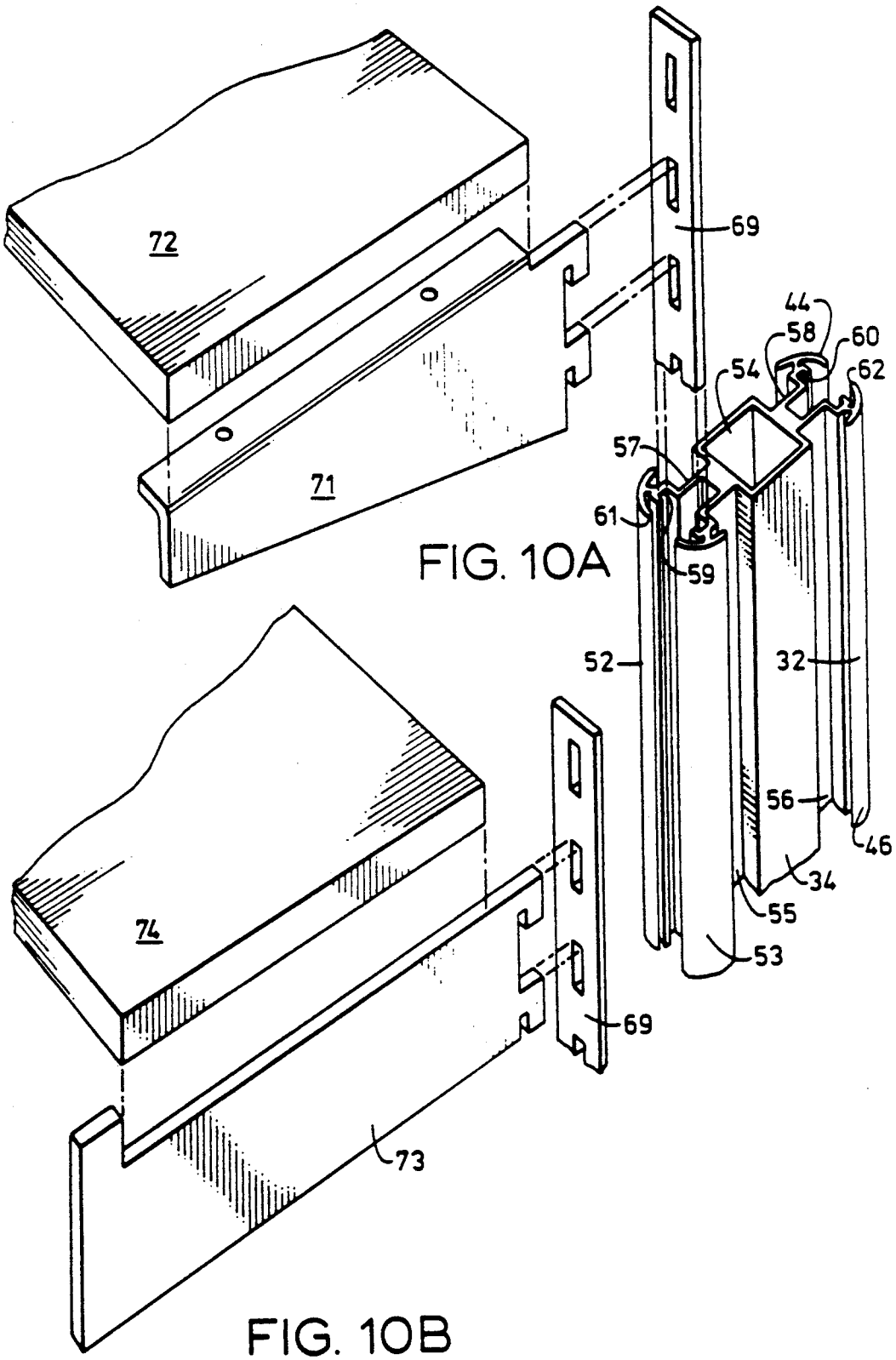
FIG. 10A is a fragmentary exploded perspective view illustrating an upright frame member of the present invention together with a slotted strip, a shelf bracket and a shelf.
FIG. 10B is a fragmentary exploded view illustrating a standard, a face-out and a shelf.

Prior to mounting of horizontal frame member 33 on upright frame members 31 and 32, the slotted channels 59 and 60 of upright frame members 31 and 32 may each be provided with a slotted standard. This is illustrated in FIG. 10A wherein a slotted standard 69 is illustrated as receivable in the slotted channel 59 of upright frame member 32. It will be understood that a slotted standard can also be mounted in the slotted channel 60 of upright frame member 32. The same is also true of slotted channels 59 and 60 of upright frame member 31. Once the horizontal frame member 33 has been mounted in place, the slotted standards 69 are captive within their respective slotted channel. The purpose of the slotted standards will be apparent hereinafter.

It is also within the scope of the present invention to enclose one or both sides of the upright frame members 31 and 32 and the horizontal frame member 33 with an elongated flexible plastic insert. Such an insert is shown at 70 in FIG. 5. The insert 70 is inserted between the exterior of the wall 38 of the rectangular portion 34 of upright frame member 31 and the adjacent edges of arcuate portions 46 and 53. It will be understood that a similar insert could be mounted on the other side of upright frame member 31. One or more inserts can also be mounted on one or both sides of the horizontal frame member 33 and upright frame member 32 in the same manner. To this end, for example, an insert 70 is shown similarly mounted on the outer side of horizontal frame member 33 in FIG. 4, while FIG. 3 shows an insert 70 mounted on the outside surface of upright frame member 32 and on the inside surface of upright frame member 31. The inserts 70 are preferably colored and are color coordinated with the replaceable skirt 29 mounted on base 2. Thus, by appropriately changing the replaceable skirt 29 and the inserts 70, the color scheme of the system display unit of the present invention can be modified.

FIG. 2, 3 and 4 illustrate the simplest form of the system display unit of the present invention. It is within the scope of the invention to provide bases like the base 2 and horizontal frame members like the horizontal frame member 33 in various end-to-end lengths. The same is true of upright frame members like upright frame members 31 and 32. While dimensions do not constitute a limitation of the present invention, in the system of the present invention the bases and horizontal frame members could be provided in lengths of 24, 30 and 48 inches, while the upright frame members could be provided in lengths of 30, 48, 54, 60, 72 and 84 inches.

Figure 10C:
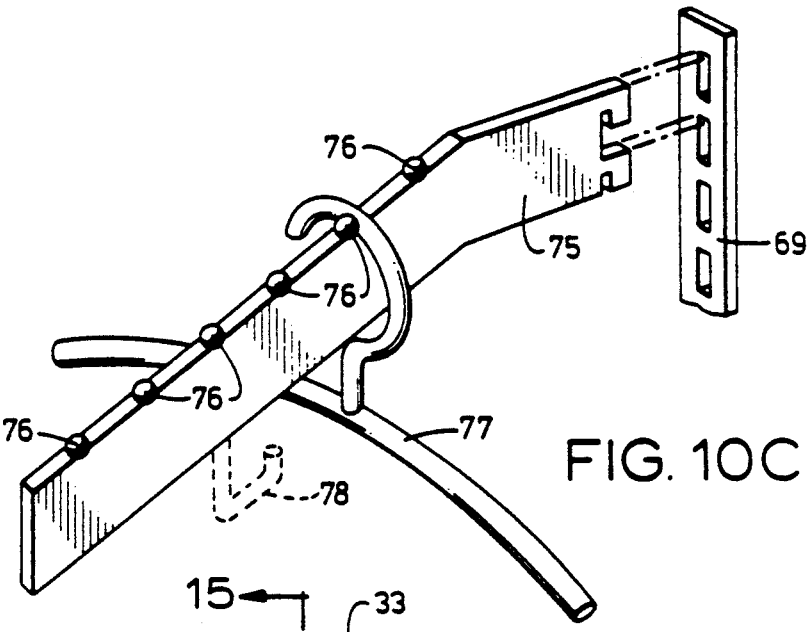
FIG. 10C is a fragmentary exploded perspective view illustrating a slotted standard and a waterfall.

In this simplest form, the slotted standards within upright frame members 31 and 32 may be used to support conventional hardware. For example, the slotted standards 69 may be used to support shelf brackets such as the bracket 71 in FIG. 10A. Such brackets, mounted in vertical alignment on one or both ends of the upright frame members 31 and 32 may be used to support shelves such as shelf 72 of FIG. 10A. In similar fashion, the slotted standards 69 may be used to support conventional face-outs such as face-out 73 in FIG. 10B. The face-out 73 may be used to support any appropriate element ranging from clothes hangers to a shelf such as shelf 74 of FIG. 10B. The slotted standards 69 of upright frame members 31 and 32 may be used to support conventional waterfall brackets such as the waterfall bracket 75 of FIG. 10C. A usual form of waterfall bracket is provided with a series of balls 76 evenly spaced along its upper edge. The balls 76 enable conventional clothes hangers or the like to be arranged on the waterfall bracket in an evenly spaced, descending manner. An exemplary clothes hanger is illustrated in FIG. 10C at 77. Another well known form of waterfall substitutes a series of J-hooks extending from its lower edge for the balls 76. One such J-hook is shown in broken lines at 78 in FIG. 10C. The J-hooks may be used to support conventional clothes hangers or the like. In some instances, the merchandise to be displayed may be suspended directly from the J-hooks.

Figure 19:
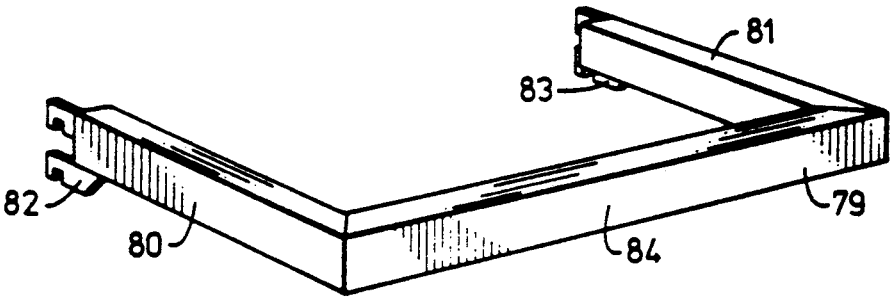
FIG. 19 is a perspective view of a conventional bracket hangbar for use with a slotted standard.

The slotted standards 69 of upright frame members 31 and 32 can also be used to support a conventional U-shaped horizontal bracket hangbar of the type illustrated in FIG. 19 at 79. The hangbar 79 comprises a pair of outwardly extending, parallel arms 80 and 81. The arms 80 and 81 are provided at one of their ends with hook-like elements 82 and 83 adapted to engage the slotted standards 69 of upright frame members 31 and 32. The forward ends of arms 80 and 81 are joined by a cross-bar 82.

The various hardware items described above are exemplary only of the types of conventional hardware which can be supported by the system display unit of FIGS. 2–4. These hardware items can be applied to one or both ends of each upright frame member 31 and 32 and in any desired combination.

The system display units thus far described comprise open upright frame assemblies mounted on base assemblies. The upright frame assembly and base assembly of a system display unit of the present invention are also capable of supporting one or two vertically oriented panels. There are numerous standard panels available for this purpose. Non-limiting examples of such panels are wire grid panels, solid panels, clear plastic panels, mirrored panels, slotted panels and slotwall panels. With the exception of the clear plastic and mirrored panels, it is within the scope of the invention to color the panels, selecting a color which will coordinate Properly with the color of base skirt 29 and the inserts 70 of upright frame members 31 and 32 and horizontal frame member 33. When a panel is to be incorporated in the structure, inserts 70 are not applied to the inwardly facing surfaces of upright frame members 31 and 32 and horizontal frame member 33.

Figure 7:
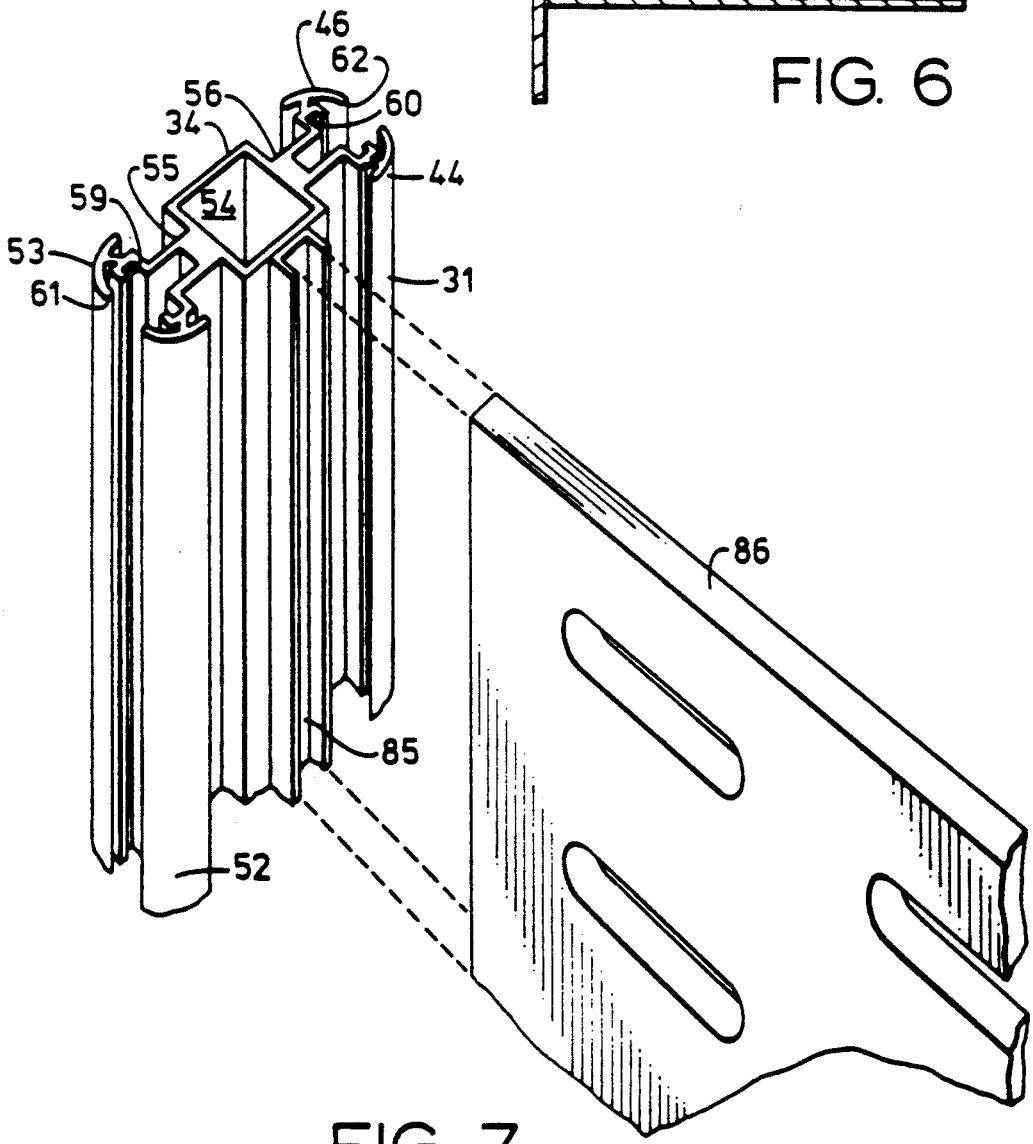
FIG. 7 is a fragmentary, exploded, perspective view of an upright frame member of the present invention and a centrally mounted panel.

When it is desired to mount a single panel centrally of the display unit, the inwardly facing wall 36 of rectangular portion 34 of each of the upright frame members 31 and 32 and the horizontal frame member 33 has a channel member mounted thereon, extending longitudinally thereof. Such a channel is illustrated at 85 in FIG. 7. The channel 85 may be affixed to the wall 36 by any appropriate means including self-tapping flathead screws (not shown). The single panel to be mounted may be of any of the types described above. For purposes of an exemplary showing, a slotted panel is illustrated at 86 in FIG. 7. In the assembly of such a unit, the upright frame members 31 and 32 are mounted on the base 2 as described above. Thereafter, the panel 86 is caused to slide downwardly into the channels 85 of the upright frame members 31 and 32. The upper edge of the panel will be further engaged by the channel 85 of the horizontal frame member, once it has been mounted in place.

With the base and frame assemblies of the present invention, it is also possible to support a panel in the inwardly facing slots 57 or the inwardly facing slots 58 of upright frame members 31 and 32 and horizontal frame member 33. This is illustrated, for example, in FIG. 8 wherein a conventional slotwall panel 87 is indicated as mounted in the inwardly facing slot 57 of upright frame member 32. It will be apparent that the upper edge of panel 87 will be received within slot 57 of horizontal frame member 32 and the far vertical edge of the panel (not shown) will be received within the slot 57 of upright frame member 31.

Figure 8:
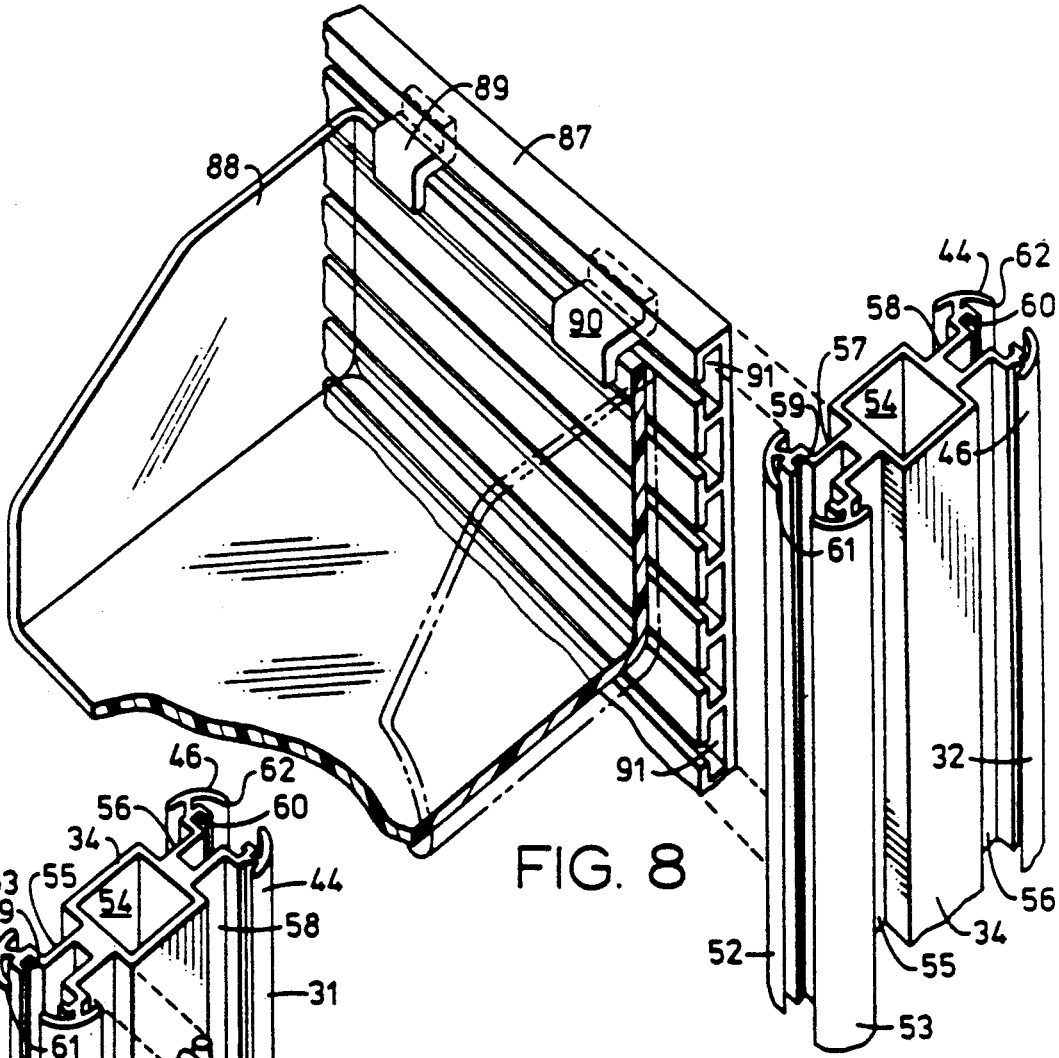
FIG. 8 is a fragmentary exploded perspective view illustrating an upright frame member of the present invention, a slotwall panel and an accessory mounted thereon.

In some instances, it may be desirable to mount two panels in the base and frame assemblies. In this instance, the panels will be arranged back-to-back, with the second panel located in the inwardly facing slots 58 of upright frame members 31 and 32 and horizontal frame member 33. Any of the above described panels can be used and the back-to-back panels may be similar or dissimilar. For example, a second slotwall panel (not shown) may be mounted in the slots 58 in back-to-back relationship with the panel 87. In this way, both sides of the system display unit will present the slotted face of a slotwall panel for the support of various slotwalf accessories. Prior art workers have devised numerous accessories to be mounted on slotwall panels including shirt bins, utility bins, accessory trays, shelves, slanted shelves, divided shelves, shoe display supports and the like. For purposes of an exemplary showing, a conventional plastic shirt bin is illustrated in FIG. 8 at 88. The shirt bin is provided with a pair of integral hook-like members 89 and 90 adapted to engage in one of the slots 91 of slotwall panel 87.

Figure 9:
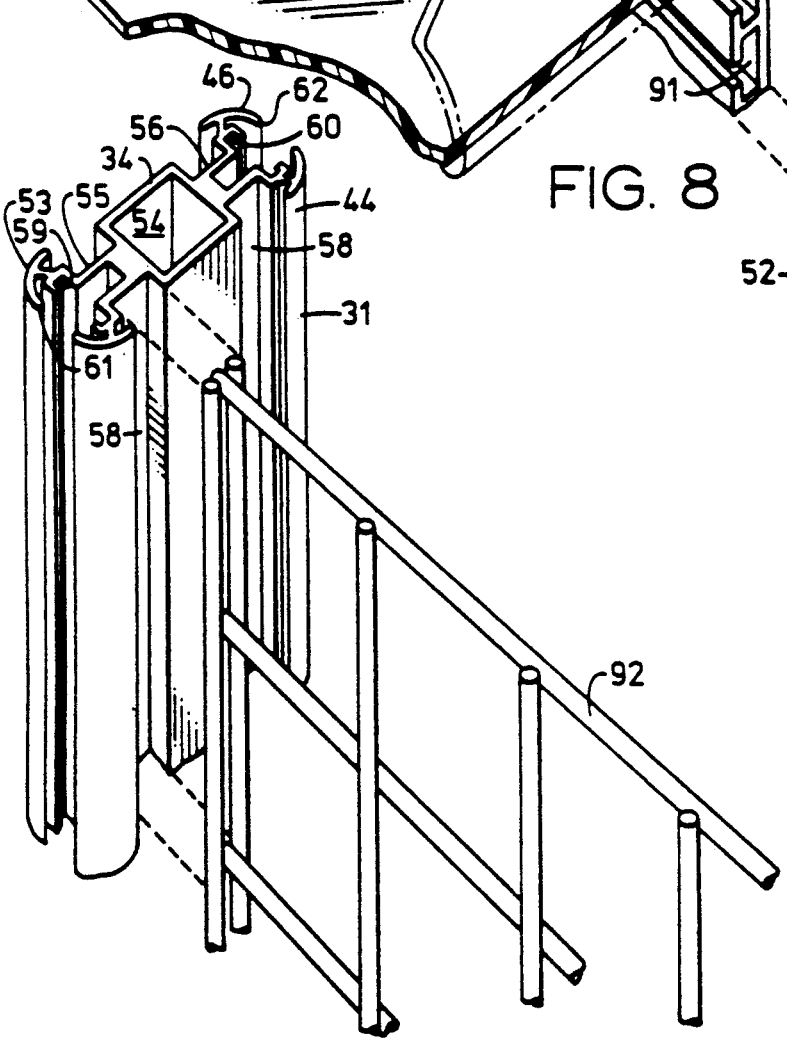
FIG. 9 is a fragmentary exploded perspective view illustrating an upright frame member of the present invention and a wire grid panel supported thereby.

FIG. 9 illustrates the mounting of a conventional wire grid panel 92 in the slot 57 of upright frame member 31. It will again be apparent that the panel 92 will additionally engage in the slots 57 of upright frame member 32 and horizontal frame member 33 (not shown). As in the case of the structure of FIG. 8, a second panel could be mounted in the inwardly facing slot 58, the second panel being the same or different from panel 92. The wire grid panel 92 may be used to support any appropriate wire grid accessories, well known in the art. FIG. 1 illustrates a system unit of the present invention wherein the base assembly 2 and the frame assembly 3 support a wire grid panel 92 and solid panel 93.

Figure 11:
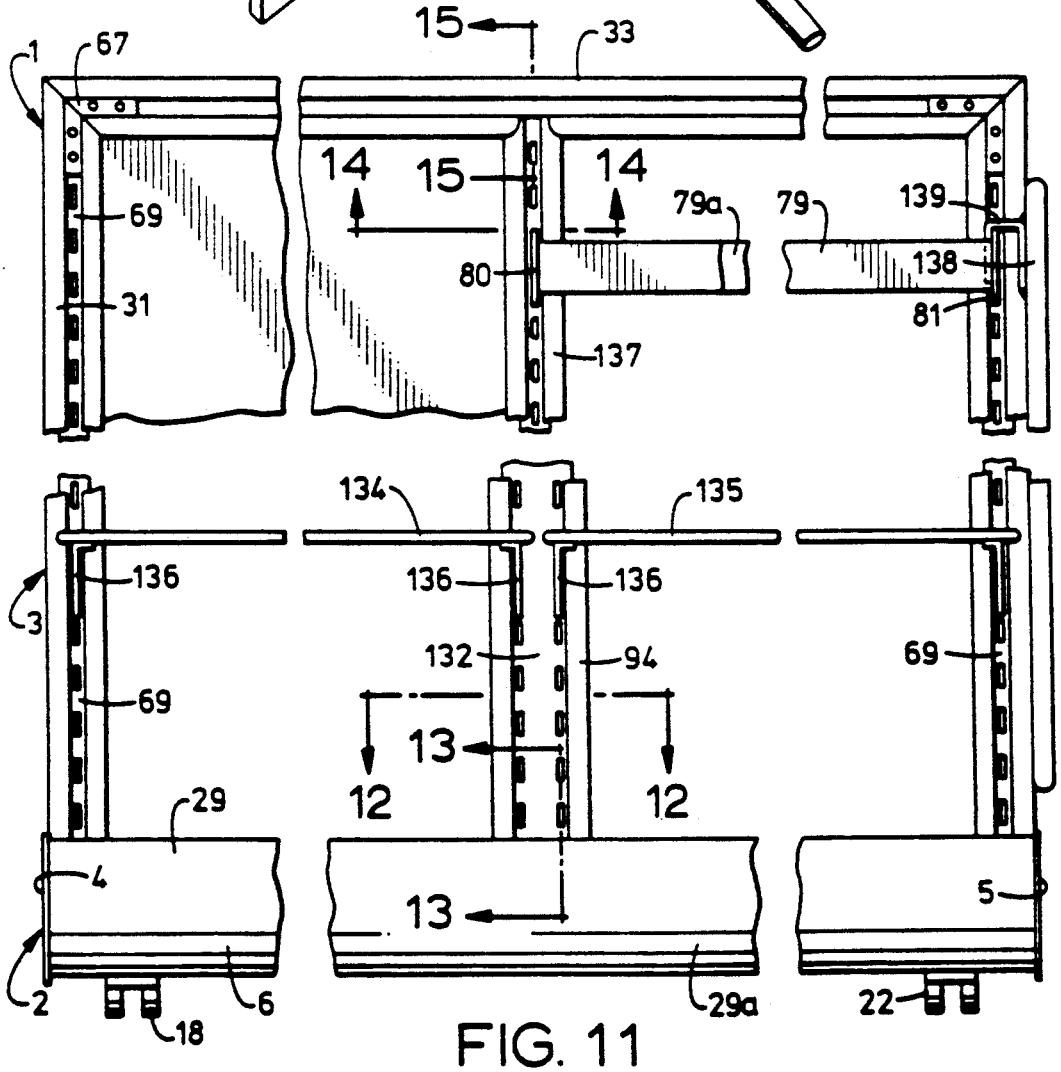
FIG. 11 is a fragmentary elevational view of an embodiment of a display unit of the merchandising system of the present invention provided with a central upright and supporting various standard hardware elements and accessories.

Reference is now made to FIG. 11 wherein another embodiment of the system of the present invention is illustrated. The embodiment of FIG. 11 differs from that of FIGS. 2–4 only in that the frame assembly 3 is provided with an intermediate upright frame member. Since the embodiment of FIG. 11 is otherwise similar to that of FIGS. 2–4, like parts have been given like index numerals. It will be understood that the embodiment of FIG. 11 is primarily intended for use with base assemblies 2 and horizontal frame members 33 of the longer end-to-end dimensions set forth above.

In FIG. 11, one form of intermediate upright frame member is indicated at 94. The intermediate frame member 94 is preferably an extrusion and has a cross-sectional configuration most clearly shown in FIG. 12. Such an extrusion is in U.S. Pat. No. Des. 317,050. Upright frame member 94 has a rectangular central portion 95 made up of walls 96, 97, 98 and 99. The walls 96–99 define a longitudinally extending rectangular socket 100 similar to the socket 54 of upright frame members 31 and 32 and horizontal frame member 33. The walls 96–99 have on their inside surfaces longitudinally extending spacing ribs 101. A pair of opposed, mirror image, hook-like elements 102 and 103 extend perpendicularly from wall 96 and cooperate to define a slotted channel 104 similar to the slotted channel 59 of upright frame members 31 and 32 and horizontal frame member 33. Webs 105 and 106 extend from the hook-like elements 102 and 103 and terminate in arcuate elements 107 and 108, respectively, similar to the arcuate elements 52 and 53 of the upright frame members 31 and 32 and the horizontal frame member 33. Arcuate elements 107 and 108 lie in parallel spaced relationship, defining a wide longitudinally extending slot 109 in the end edge of the intermediate frame member 94.

In similar fashion, a pair of opposed, mirror image hook-like elements 110 and 111 extend perpendicularly from the wall 98. The hook-like elements 110 and 111 define a slotted channel 112, similar to the slotted channel 60 of upright frame members 31 and 32 and horizontal frame member 33. The hook-like elements 110 and 111 have webs 113 and 114 extending therefrom and terminating in arcuate members 115 and 116 respectively. The arcuate members 115 and 116 are similar to the arcuate members 44 and 46 of the uprightframe members 31 and 32 and the horizontal frame member 33. The arcuate members 115 and 116 lie in parallel spaced relationship, defining a wide, longitudinally extending slot in the end edge of intermediate frame member 94.

Intermediate frame member 94 is completed by the provision of a pair of short longitudinally extending walls 118 and 119 extending perpendicularly from wall 97 and a similar pair of short, longitudinally extending walls 120 and 121 extending perpendicularly from wall 99. A comparison of FIGS. 12 and 5 clearly indicates that the sides of intermediate frame member 94 are provided with longitudinally extending slots 122, 123, 124 and 125 equivalent to the longitudinally extending slots 55, 56, 57 and 58, respectively of upright frame members 31 and 32 and horizontal frame member 33. Similarly, the short longitudinal walls 118, 119, 120 and 121 define central, longitudinally extending slots 126 and 127, equivalent to the slot provided by channel 85 in FIG. 7.

Figure 13:
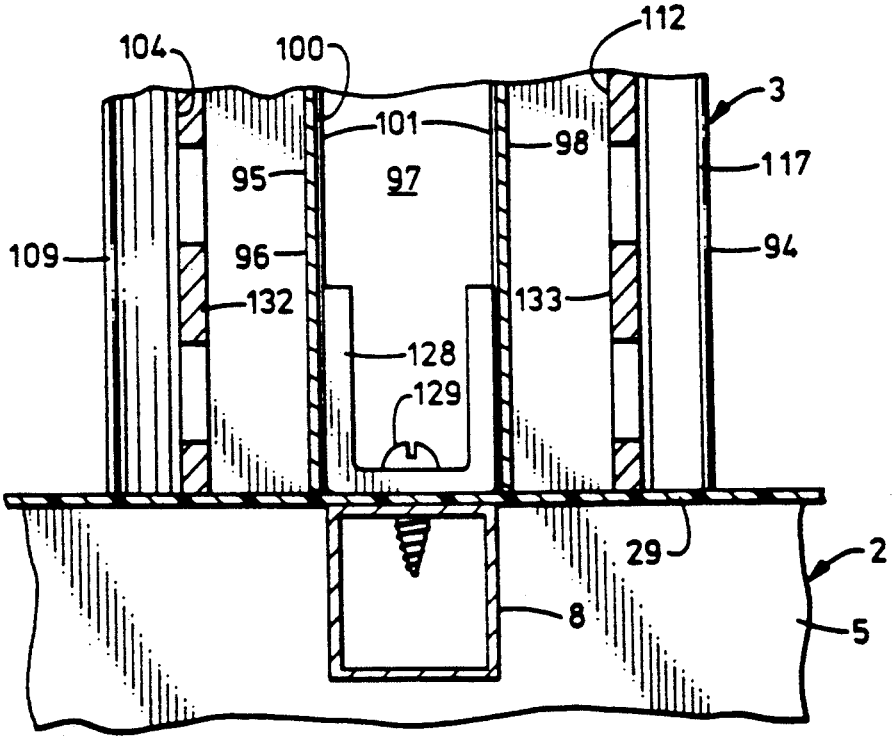
FIG. 13 is a fragmentary cross-sectional view taken along section line 13—13 of FIG. 11.

FIG. 13 illustrates the manner in which the intermediate frame member 94 is mounted on base assembly 2. To this end, a U-shaped bracket 128 is mounted by means of a self-tapping screw 129, or the like, to the longitudinal center of intermediate tubular member 8 of base assembly 2. The legs of bracket 128 extend upwardly as shown in FIG. 13. The bracket is so sized as to be just nicely received in the rectangular socket 100 formed by the central rectangular portion 95 of intermediate frame member 94.

Figure 15:
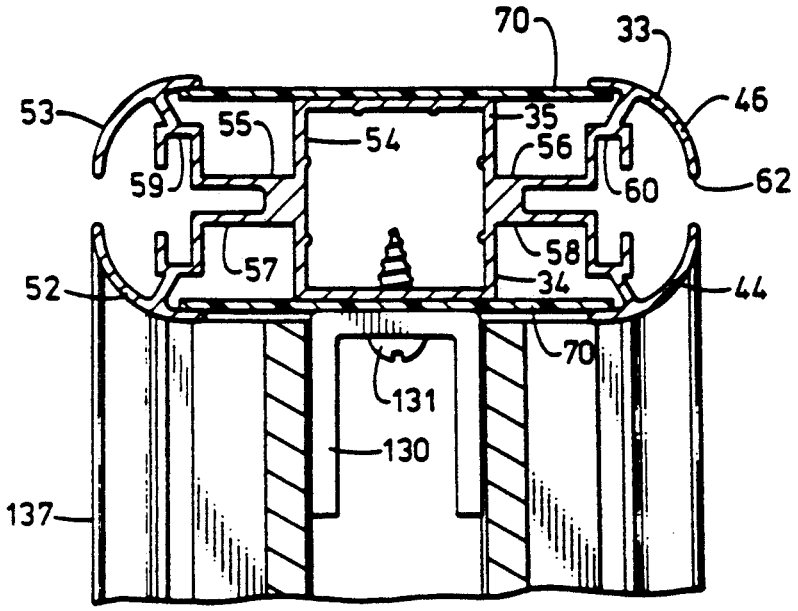
FIG. 15 is a fragmentary cross-sectional view taken along section line 15—15 of FIG. 11.

The upper end of intermediate frame member 94 is shaped to conform to the inwardly facing surface of horizontal frame member 33. The intermediate frame member 94 is affixed to the horizontal frame member 33 by means of a U-shaped bracket 130, similar to bracket 128 and attached to the rectangular central portion 34 of horizontal frame member 33 at its longitudinal center by means of a self-tapping screw 131 or the like. This is illustrated in FIG. 15.

Figure 12:
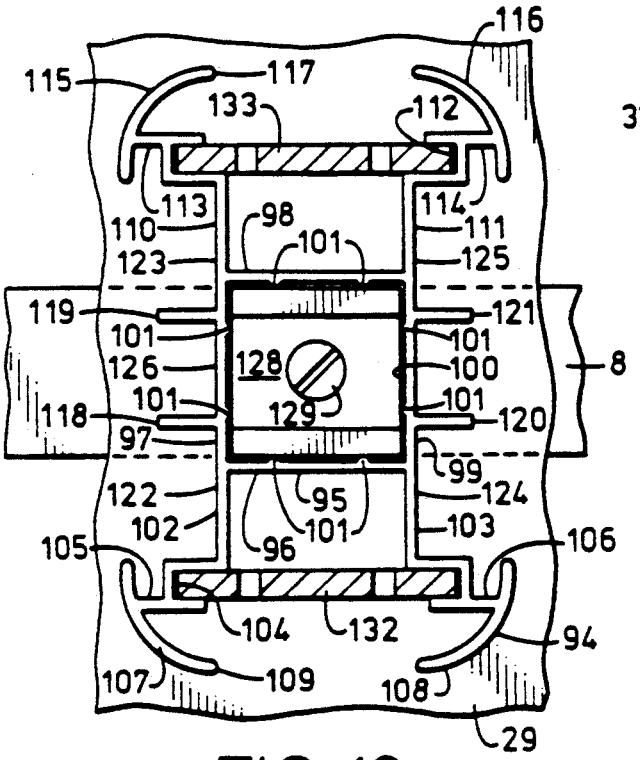
FIG. 12 is a fragmentary cross-sectional view taken along section line 12—12 of FIG. 11.

As is most clearly shown in FIGS. 11 and 12, the slotted channels 104 and 112 of intermediate frame member 94 are configured to retain double-wide slotted standards 132 and 133. Slotted standards 132 and 133 are similar to the above-described slotted standards 69 with the exception that they are approximately twice as wide and are Provided with two parallel rows of slots.

The use of the embodiment of FIG. 11 as thus far described is substantially the same as the use of the embodiment of FIGS. 2-4. Any of the hardware and accessories described heretofore can be applied to the embodiment of FIG. 11 in the same manner. As an exemplary illustration, FIG. 11 shows a pair of shelves 134 and 135 (equivalent to shelf 72 of FIG. 10A) mounted on brackets 136 (equivalent to bracket 71 of FIG. 10A). Either or both of the portions of the frame assembly to the right and to the left of intermediate frame member 94 can support one or two panels in the same manner described with respect to FIGS. 7, 8 and 9. When panels are not supported on either or both sides of intermediate frame member 94, these sides may be provided with flexible, colored inserts equivalent to insert 70 described with respect to FIG. 5.

Figure 14:
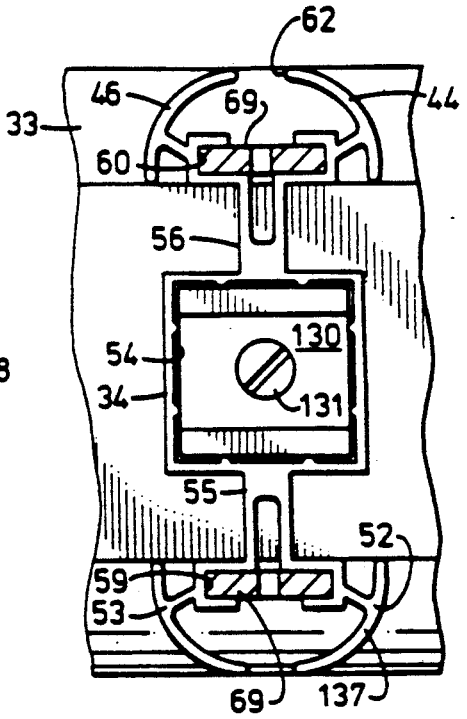
FIG. 14 is a fragmentary cross-sectional view taken along section line 14—14 of FIG. 11.

It is within the scope of the invention, in the embodiment of FIG. 11, to provide an intermediate frame member 137 (rather than intermediate frame member 94) which is identical in cross-section to upright frame members 31 and 32 and horizontal frame member 33. This is illustrated in FIGS. 11, 14 and 15. The cross-sectional configuration of intermediate frame member 137 is identical to that described with respect to FIG. 5 and like parts have been given like index numerals. The intermediate frame member 137 is mounted to the base assembly 2 and frame assembly 3 in the same manner as intermediate frame member 94. Thus, the rectangular socket 54 formed by the rectangular central portion 34 of intermediate frame member 137 is adapted to engage the U-shaped bracket 128 in the same manner as does intermediate frame member 94, illustrated in FIG. 13. The upper end of intermediate frame member 137 is configured to conform to the inwardly facing side of horizontal frame member 33 and is attached thereto by U-shaped bracket 130, as is shown in FIG. 15.

In the embodiment of FIG. 11, utilizing intermediate frame member 137, the system display unit structure is again capable of supporting the various hardware and accessories described above with respect to the embodiment of FIGS. 2-4. The structure is also capable of supporting one or two panels to either side of intermediate frame member 137 in the same manner described with respect to FIGS. 7, 8 and 9.

As a simple illustration of the use of fixtures in the embodiment of FIG. 11 utilizing intermediate frame member 137, FIG. 11 illustrates a bracket hangbar mounted thereon. The hangbar is identical to hangbar 79 of FIG. 19 and is indicated by the same index numeral. As is apparent from FIGS. 11 and 14, the intermediate upright 127 is capable of mounting slotted standards 69 in the same manner described with respect to upright frame members 31 and 32.

FIG. 11 illustrates an additional accessory for the system display unit of the present invention. As indicated above, hangbar 79 is illustrated in FIG. 11. Let it be assumed that a second hangbar is mounted on the opposite side of the frame assembly 3 directly opposite and in alignment with hangbar 79. The second hangbar is illustrated at 79*a* in FIG. 11. The additional accessory comprises an elongated framed mirror 138. Mounted on the back of mirror 138, near its upper end, is a pair of aligned and spaced U-shaped brackets, one of which is shown at 139. The bracket 139 engages the adjacent arm 81 of hangbar 79 It will be understood that the second U-shaped bracket (not shown) will similarly engage the adjacent arm (not shown) of hangbar 79*a*. In this way, mirror 138 is securely mounted on the end of the system display unit.

Figure 16:
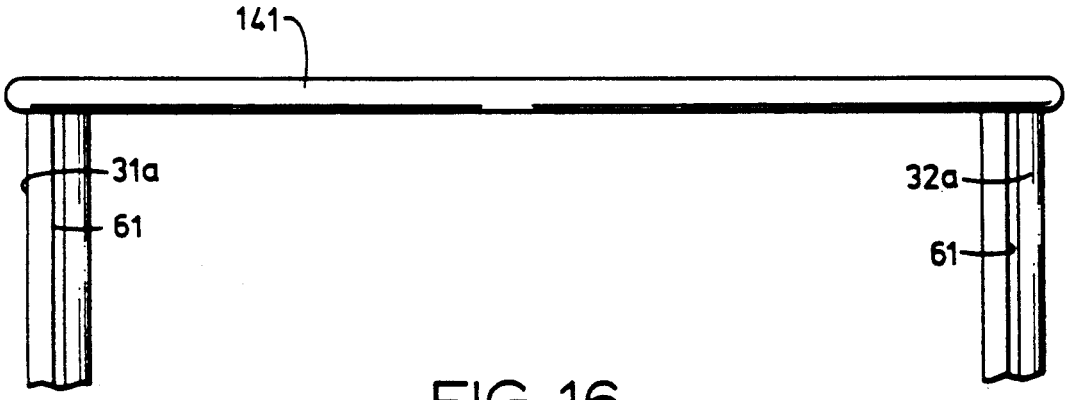
FIG. 16 is a fragmentary elevational view of a horizontal frame member in the form of a table top fixed to the upper ends of a pair of uprightframe members.
Figure 17:
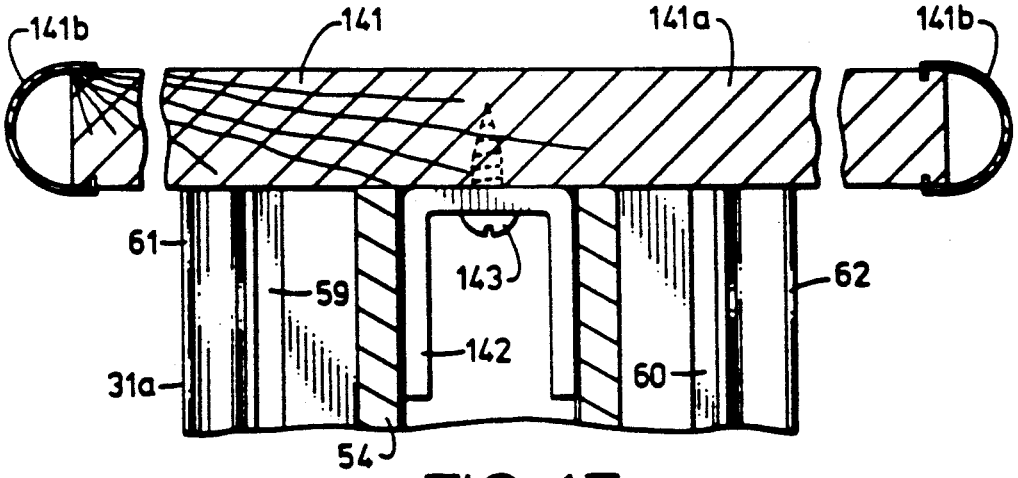
FIG. 17 is a cross-sectional view taken along section lines 17—17 of FIG. 16.
Figure 18:
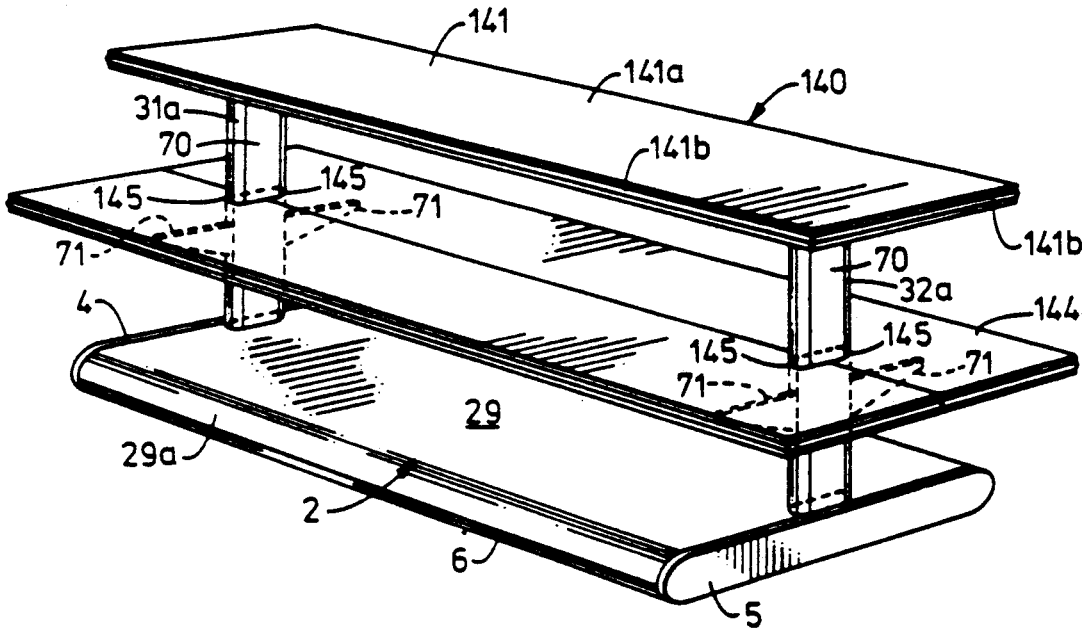
FIG. 18 is a perspective view of a display unit of the merchandising system of the present invention in the form of a feature table.

FIGS. 16, 17 and 18 illustrate another embodiment of the system display unit of the present invention. In this instance, the embodiment comprises a feature table generally indicated at 140. The feature table 140 comprises a base assembly 2, identical to the base assemblies described with respect to the embodiment of FIGS. 2–4 and the embodiment of FIG. 11. As a consequence, like parts have been given like index numerals. The base assembly 2 may have any appropriate end-to-end length. The base assembly 2 supports a pair of upright frame members 31*a* and 32*a* which are identical to the upright frame members 31 and 32 of FIGS. 2–4 and 11, with the exception that their upper ends are not beveled. The inwardly and outwardly facing side surfaces of upright frame members 31*a* and 32*a* may be provided with inserts 70 of the type described with respect to FIG. 5 and color coordinated with the base skirt 29. Two such inserts are shown at 70 in FIG. 18.

The primary differences between the structure of FIG. 18 and that of FIGS. 2–4 relate to the upright frame members 31*a* and 32*a* which usually are shorter than the ones used in the embodiment of FIGS. 2–4 Nevertheless, the upright frame members 31*a* and 32*a* may be of any appropriate end-to-end length. Additionally, in the embodiment of FIG. 18, the horizontal frame member 33 of FIGS. 2–4 has been replaced by a table top 141. While the table top 141 may be of any appropriate construction and made of any appropriate material, for purposes of an exemplary showing it is illustrated in FIGS. 16–18 as comprising a planar wood or pressboard panel 141*a* provided with an edge trim 141*b*. The table top 141 is affixed to the upper end of upright frame member 31*a* by means of a U-shaped bracket 142 identical to the U-shaped brackets 128 of FIG. 13 and 130 of FIG. 15. The U-shaped bracket 142 is attached to the table top 141 by a screw 143, or other appropriate fastening means. The U-shaped bracket 142 is adapted to be inserted in the central rectangular socket 54 of upright frame member 31*a*, as shown in FIG. 17. It will be understood that attachment of the table top 141 to upright frame member 32*a* is accomplished in exactly the same manner.

The upright frame members 31*a* and 32*a* support slotted standards (not shown) identical to those shown in FIGS. 5 and 10A at 69. The slotted standards, themselves, support pairs of brackets similar to bracket 71 of FIG. 10A. Such brackets are shown in phantom lines in FIG. 18. The brackets 71, in turn, support shelves. The number of shelves per side of the feature table and the arrangement thereof can be varied, depending upon the ultimate use of the feature table. The shelves could be of the type illustrated at 72 in FIG. 10A. For purposes of an exemplary showing, the shelves 144 of FIG. 18 are identical and are longer than the base assembly 2. Each of the shelves 144 is provided with a notch to accommodate each of the upright frame members 31*a* and 31*b*. Such notches are shown at 145. The notches enable the facing edges of the shelves to abut each other to form the equivalent of a single overall shelf, when brackets 71 of each upright frame member 31*a* and 32*a* are aligned with each other.

From the above descriptions it will be apparent that the system display units can be made up in many different configurations depending upon the merchandise to be displayed. The frame assembly portion of a display unit may define a single rectangular area as in the embodiment of FIGS. 2–4 or a pair of rectangular areas as in the embodiment of FIG. 11. Such display units may support conventional panels as well as conventional hardware and accessories, as indicated above. The display units can be converted to feature tables, as last described.

When a retail store or a department of a department store is to be renovated, the system units of the present invention can be easily reassembled into any of the configurations described above, depending upon the merchandise to be displayed. Through appropriate selection of skirts, shelves, panels and inserts, appropriate color coordination can also be achieved.

Modifications may be made in the invention without department from the spirit of it.

What is claimed is:

1. A display unit for items for sale, said display unit comprising a rectangular base assembly having sides and ends and an upright frame assembly removably mounted on said base assembly along the centerline thereof extending from end to end thereof, said base assembly comprising a pair of end members joined together by a pair of parallel spaced outer longitudinal members defining sides of said base and by a longitudinal intermediate base member centered between said outer longitudinal members, a replaceable cover for said base covering said outer longitudinal members and said intermediate base member and providing said base with a smooth upper surface, said upright frame assembly comprising at least a pair of first and second elongated upright frame members having lower ends removably affixed to said intermediate base member adjacent said base end members, said first and second upright frame members having upper ends, an elongated horizontal frame member being removably affixed to said first and second upright frame member upper ends, said first and second upright frame members having longitudinal sides and edges, each of said first and second upright frame member edges having a longitudinal recessed channel formed therein, whereby standard display hardware can be engaged in said recessed channels on either edge of said first and second upright frame members.

2. The display unit claimed in claim 1 wherein said horizontal frame member and said first and second upright frame members have the same cross section, means on said sides of said frame members defining longitudinally extending slots therein, a replaceable vertically oriented panel supported by said base assembly and framed by said frame members, said panel having side and top edges removably engaged in selected ones of said frame member slots.

3. The display unit claimed in claim 1 wherein said horizontal frame member and said first and second upright frame members have the same cross section, means on said sides of said frame members defining multiple longitudinally extending slots therein, a pair of replaceable vertically oriented panels in parallel spaced back-to-back relationship supported on said base assembly and framed by said frame members with the top and side edges of said panels removably engaged in selected ones of said frame member slots.

4. The display unit claimed in claim 1 including a third intermediate upright frame member, said third upright frame member being parallel to said first and second upright frame members and being removably affixed to said intermediate base member and said horizontal frame member, said third upright frame member having longitudinal sides and edges said third upright frame member edges each having a longitudinal recessed channel formed therein, whereby standard display hardware can be engaged in said recessed channel on either edge of said third upright frame member.

5. The display unit claimed in claim 1 wherein said first and second upright frame members and said horizontal frame member comprise extruded metallic members of identical cross section.

6. The display unit claimed in claim 1 wherein said horizontal frame member comprises a table top, brackets mounted in said recessed channels in said edges of said first and second upright frame members and shelves supported on said bracket, whereby said display unit comprises a feature table.

7. The display unit claimed in claim 1 wherein said horizontal frame member has longitudinal sides and edges, replaceable elongated strips removably mountable on said sides of said frame members, said strips being color coordinated with said base assembly cover.

8. The display unit claimed in claim 2 wherein said panel is chosen from the class consisting of a wire grid panel, a solid panel, a clear plastic panel, a mirrored panel, a slotted panel and a slotwall panel.

9. The display unit claimed in claim 2 wherein said first and second upright frame members and said horizontal frame member comprise extruded metallic members of identical cross section.

10. The display unit claimed in claim 2 including replaceable elongated strips removably mountable on those sides of said frame members not engaged by said panel, said strips, said panel and said base assembly cover being color coordinated.

11. The display unit claimed in claim 3 wherein said panels are chosen from the class consisting of wire grid panels, solid panels, clear plastic panels, mirrored panels, slotted panels and slotwall panels.

12. The display unit claimed in claim 3 wherein said first and second upright frame members and said horizontal frame member comprise extruded metallic members of identical cross section.

13. The display unit claimed in claim 3 including replaceable elongated strips removably mountable on those sides of said frame members not engaged by said panels, said strips, said panels and said base assembly cover being color coordinated.

14. The display unit claimed in claim 4 wherein said first, second and third upright frame members and said horizontal frame member comprise extruded metallic members of the same cross section.

15. The display unit claimed in claim 4 including means on said sides of said frame members defining longitudinally extending slots therein, a replaceable vertically oriented panel supported by said base assembly and framed by said third upright frame member, said horizontal frame member and one of said first and second upright frame members with the side and top edges of said panel removably engaged in selected ones of said frame member slots.

16. The display unit claimed in claim 4 including means on said sides of said frame members defining longitudinally extending slots therein, a pair of replaceable vertically oriented panels each supported by said base assembly and framed by said third upright frame member, said horizontal frame member and one of said first and second upright frame members with the sides and top edges of said panels removably engaged in selected ones of said frame member slots.

17. The display unit claimed in claim 4 including means on said sides of said frame members defining a plurality of longitudinally extending slots therein, a pair of replaceable vertically oriented panels in back-to-back relationship, said pair of panels being supported by said base assembly and framed by said third upright frame member, said horizontal frame member and one of said first and second upright frame members with the side and top edges of said panel removably engaged in selected ones of said frame member slots.

18. The display unit claimed in claim 4 including means on said sides of said frame members defining a plurality of longitudinally extending slots therein, two pairs of replaceable vertically oriented panels the panels of each pair being in back-to-back relationship and each pair being supported by said base assembly and framed by said third upright frame member, said horizontal frame member and one of said first and second upright frame members with the sides and top edges of said panels removably engaged in selected ones of said frame member slots.

19. The display unit claimed in claim 4 wherein said horizontal frame member has longitudinal sides and edges, replaceable elongated strips removably mountable on said sides of said frame members, said strips being color coordinated with said base assembly cover.

20. The display unit claimed in claim 15 wherein said horizontal frame member has longitudinal sides and edges, replaceable elongated strips removably mountable on those sides of said frame members not engaged by said panel, said strips, said panel and said base assembly cover being color coordinated.

21. A merchandising system for the display of items for sale, said merchandising system comprising a plurality of display units, each said display unit comprising a rectangular base assembly having sides and ends and an upright frame assembly removably mounted on said base assembly along the centerline thereof extending from end to end thereof, said base assembly comprising a pair of end members joined together by a pair of parallel spaced outer longitudinal members defining sides of said base and by a longitudinal intermediate base member centered between said outer longitudinal members, a replaceable cover for said base covering said outer longitudinal members and said intermediate base member and providing said base with a smooth upper surface, said upright frame assembly comprising at least a pair of first and second elongated upright frame members having lower ends removably affixed to said intermediate base member adjacent said base end members, said first and second upright frame members having upper ends, an elongated horizontal frame member being removably affixed to said first and second upright frame member upper ends, said first and second upright frame members having longitudinal sides and edges, each of said first and second upright frame member edges having a longitudinal recessed channel formed therein, whereby standard display hardware can be engaged in said recessed channels on either edge of said first and second upright frame members.

22. The merchandising system claimed in claim 21 wherein said horizontal frame member and said first and second upright frame members of each display unit have the same cross section, means on said sides of said frame members defining longitudinally extending slots therein, a replaceable vertically oriented panel for each unit supported by said base assembly thereof and framed by said frame members thereof, said panel having side and top edges removably engaged in selected ones of said frame member slots.

23. The merchandising system claimed in claim 21 wherein said horizontal frame member and said first and second upright frame members of each unit have the same cross section, means on said sides of said frame members of each unit defining multiple longitudinally extending slots therein, a pair of replaceable vertically oriented panels for each unit in parallel spaced back-to-back relationship supported on said base assembly thereof and framed by said frame members thereof with the top and side edges of said panels removably engaged in selected ones of said frame member slots.

24. The merchandising system claimed in claim 21 including a third intermediate upright frame member for each unit, said third upright frame member being parallel to said first and second upright frame members of said unit and being removably affixed to said intermediate base member and said horizontal frame member of said unit, said third upright frame member having longitudinal sides and edges, said third upright frame member edges each having a longitudinal recessed channel formed therein, whereby standard display hardware can be engaged in said recessed channel on either edge of said third upright frame member.

25. The merchandising system claimed in claim 24 including means on said sides of said frame members of each unit defining longitudinally extending slots therein, a replaceable vertically oriented panel for each unit supported by said base assembly thereof and framed by said third upright frame member, said horizontal frame member and one of said first and second upright frame members thereof with the side and top edges of said panel removably engaged in selected ones of said frame member slots.

26. The merchandising system claimed in claim 24 including means on said sides of said frame members of each unit defining longitudinally extending slots therein, a pair of replaceable vertically oriented panels for each unit each supported by said base assembly thereof and framed by said third upright frame member, said horizontal frame member and one of said first and second upright frame members thereof with the sides and top edges of said panels removably engaged in selected ones of said frame member slots.

27. The merchandising system claimed in claim 24 including means on said sides of said frame members of each unit defining a plurality of longitudinally extending slots therein, a pair of replaceable vertically oriented panels for each unit in back-to-back relationship, said pair of panels of each unit being supported by said base assembly thereof and framed by said third upright frame member, said horizontal frame member and one of said first and second upright frame members thereof with the side and top edges of said panels removably engaged in selected ones of said frame member slots.

28. The merchandising system claimed in claim 24 including means on said sides of said frame members of each unit defining a plurality of longitudinally extending slots therein, two pairs of replaceable vertically oriented panels for each unit in back-to-back relationship, said pairs of panels of each unit being supported by said base assembly thereof and framed by said third upright frame member, said horizontal frame member and one of said first and second upright frame members thereof with the sides and top edges of said panels removably engaged in selected ones of said frame member slots.

* * * * *